US009777727B2

(12) United States Patent
Sacchet

(10) Patent No.: US 9,777,727 B2
(45) Date of Patent: Oct. 3, 2017

(54) BATCHING/DELIVERING SYSTEM COMPRISING AT LEAST ONE REMOTELY ACTUATED VOLUMETRIC BATCHING PUMP

(71) Applicant: STAN ENGINEERING CORP. S.R.L., Salmour (IT)

(72) Inventor: Alessandro Sacchet, Salmour (IT)

(73) Assignee: STAN ENGINEERING CORP. S.R.L., Salmour, Cuneo (IT)

( * ) Notice: Subject to any disclaimer, the term of this patent is extended or adjusted under 35 U.S.C. 154(b) by 24 days.

(21) Appl. No.: 14/911,461

(22) PCT Filed: Aug. 12, 2014

(86) PCT No.: PCT/IT2014/000216
§ 371 (c)(1),
(2) Date: Feb. 10, 2016

(87) PCT Pub. No.: WO2015/022714
PCT Pub. Date: Feb. 19, 2015

(65) Prior Publication Data

US 2016/0195086 A1 Jul. 7, 2016

(30) Foreign Application Priority Data

Aug. 12, 2013 (IT) ..... TO2013A0690

(51) Int. Cl.
*F04C 2/107* (2006.01)
*F04C 13/00* (2006.01)
(Continued)

(52) U.S. Cl.
CPC ..... *F04C 2/107* (2013.01); *F04B 13/02* (2013.01); *F04C 2/1071* (2013.01);
(Continued)

(58) Field of Classification Search
CPC ..... F04C 2/107; F04C 2/1071; F04C 2/1073; F04C 15/008; F04C 15/06; F04C 13/001; F04B 13/02
See application file for complete search history.

(56) References Cited

U.S. PATENT DOCUMENTS 4,407,431 A * 10/1983 Hutter, III ..... B01F 3/088 141/107
4,778,080 A * 10/1988 Ono ..... B67D 7/66 222/255

(Continued)

FOREIGN PATENT DOCUMENTS

CN 2746160 12/2005
GB 2305470 4/1997

(Continued)

OTHER PUBLICATIONS

Int'l. Search Report, dated Apr. 11, 2014 for Int'l Appl. PCT/IT2014/000216.

*Primary Examiner* — Frederick C Nicolas
(74) *Attorney, Agent, or Firm* — Pasadena Legal Group; Norman R. Van Treeck

(57) ABSTRACT

A batching/delivering system for delivering and batching high viscosity products, having at least one managing and actuating device, where the managing and actuating device have at least one control motor and at least one remotely-actuated volumetric batching pump for delivering and batching high viscosity products. The remotely-actuated volumetric batching pump has at least one sucking, volumetrically batching and delivering element with a first duct for sucking the product to be batched, at least one volumetric batching device of the product, and at least one second duct for exiting the product batched by the device. The device is
(Continued)

connected to at least one control motor of the device by interposing at least one flexible rotary shaft.

12 Claims, 3 Drawing Sheets

(51) Int. Cl.
*F04C 15/00* (2006.01)
*F04C 15/06* (2006.01)
*F04B 13/02* (2006.01)

(52) U.S. Cl.
CPC ..... *F04C 2/1073* (2013.01); *F04C 13/001* (2013.01); *F04C 15/008* (2013.01); *F04C 15/06* (2013.01)

(56) References Cited

U.S. PATENT DOCUMENTS 5,499,745 A * 3/1996 Derian ..... B01F 15/047 222/136
5,953,567 A * 9/1999 Muramatsu ..... G03G 15/0822 222/DIG. 1
6,059,144 A * 5/2000 Vollmar ..... B29C 47/10 222/135
6,070,764 A 6/2000 Cline et al.
6,082,289 A * 7/2000 Cavallaro ..... B05C 11/1034 118/243
6,085,943 A * 7/2000 Cavallaro ..... G01F 11/021 222/309
6,511,301 B1 * 1/2003 Fugere ..... B05C 11/10 222/251
6,691,895 B2 * 2/2004 Strecker ..... G01F 13/005 222/145.1
6,935,534 B2 * 8/2005 Strecker ..... B01F 7/00216 222/145.1
6,983,867 B1 * 1/2006 Fugere ..... B05C 11/10 222/261
8,684,234 B2 * 4/2014 Bacellar ..... B01F 3/18 222/1
2002/0192093 A1 12/2002 Gantenhammer
2007/0000941 A1 * 1/2007 Hadden ..... A47K 5/1217 222/52
2009/0020564 A1 * 1/2009 Weiss ..... B05C 17/00569 222/333
2010/0181337 A1 * 7/2010 Ikushima ..... B05C 5/0225 222/1

FOREIGN PATENT DOCUMENTS

JP 2001271764 10/2001
WO 9824722 6/1998

* cited by examiner

BATCHING/DELIVERING SYSTEM COMPRISING AT LEAST ONE REMOTELY ACTUATED VOLUMETRIC BATCHING PUMP

CROSS-REFERENCE TO RELATED APPLICATIONS

The present Application is a national stage of International Patent Application No. PCT/IT2014/000216, titled "Batching/Delivering System Comprising At Least One Remotely Actuated Volumetric Batching Pump," filed 12 Aug. 2014, which claims priority from Italian Patent Application No. TO2013A000690 filed 12 Aug. 2013, the contents of which are incorporated in this disclosure by reference in their entirety.

BACKGROUND OF THE INVENTION

1) Field of the Invention

The present invention refers to a remotely actuated volumetric batching pump and to a batching/delivering system comprising at least one of such pumps.

2) Background Art

For batching and delivering high viscosity products, such as, for example, glues, mastex, grease, etc., the art proposes substantially two types of batching devices, namely batching devices with pressure-time relationship (the so-called "pressure-time" batching devices) and volumetric batching devices. However, while pressure-time batching devices have scarce accuracy and batching repeatability features, the volumetric batching devices allow high and constant batching accuracies. In particular, known volumetric batching devices, having either gears or pistons, lobes, etc., are actuated by control motors integrated in the batching device itself, consequently requiring suitable protection precautions against possible seepage by the product to be batched, which could impair, if not even prevent, their correct operation. Moreover, their configurations make these batching devices relatively encumbrant, since they anyway require the necessary connections of control and electric supply systems adapted to manage the motors operation, compelling the related batching device to be used only inside actual batching stations, consequently resulting scarcely practical for possible uses in the field or in a yard.

Moreover, in several technologic fields, such as for example electronics, electro-mechanics and plastic working, it is necessary to use two-component products, usually composed of a resin and a catalyst, which must be mixed in pre-established ratios and batched, sometimes with minimum volumes and with accuracy: these batchings are typically performed through dispensing stations which are able to independently supply the two components till a batching device which determines their amount, performs the (static or dynamic) mixing and carries out the batching in the preset point or inside small containers.

Known dispensing stations substantially comprise the two following types of volumetric batching systems:

- with pneumatic actuation when mixing volumes and ratios can remain fixed for the whole length of time of the batching type to be performed;
- with motored actuation with servo-motors, served by electronic controls capable of changing some parameters (volume, batching time, batching speed) directly from video and with strong reduction of time if batch is eventually changed.

Similarly to above, however, also in volumetric batching systems, the related volumetric pumps are directly connected to their related control motors, with the following problems of reliability and flexibility of use.

CN-Y-2 746 160 discloses a batching pump and WO-A2-98/24722 disclose a batching system according to the preamble of claim 1.

SUMMARY OF THE INVENTION

Object of the present invention is solving the above prior art problems, by providing a remotely actuated volumetric batching pump which is more reliable and allows a higher flexibility of use with respect to what is proposed by the prior art.

Another object of the present invention is solving the above prior art problems by providing a batching/delivering system comprising at least one remotely-actuated pump which is more reliable and allows a higher flexibility of use with respect to what is proposed by the prior art.

The above and other objects and advantages of the invention, as will result from the following description, are obtained with a remotely actuated volumetric batching pump and a batching/delivering system as claimed in the respective independent Claims.

Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) could be made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which:

FIG. 5 shows a block diagram which schematically shows an alternative embodiment of the system according to the present invention.

DETAILED DESCRIPTION OF PREFERRED EMBODIMENTS

Figure 1:
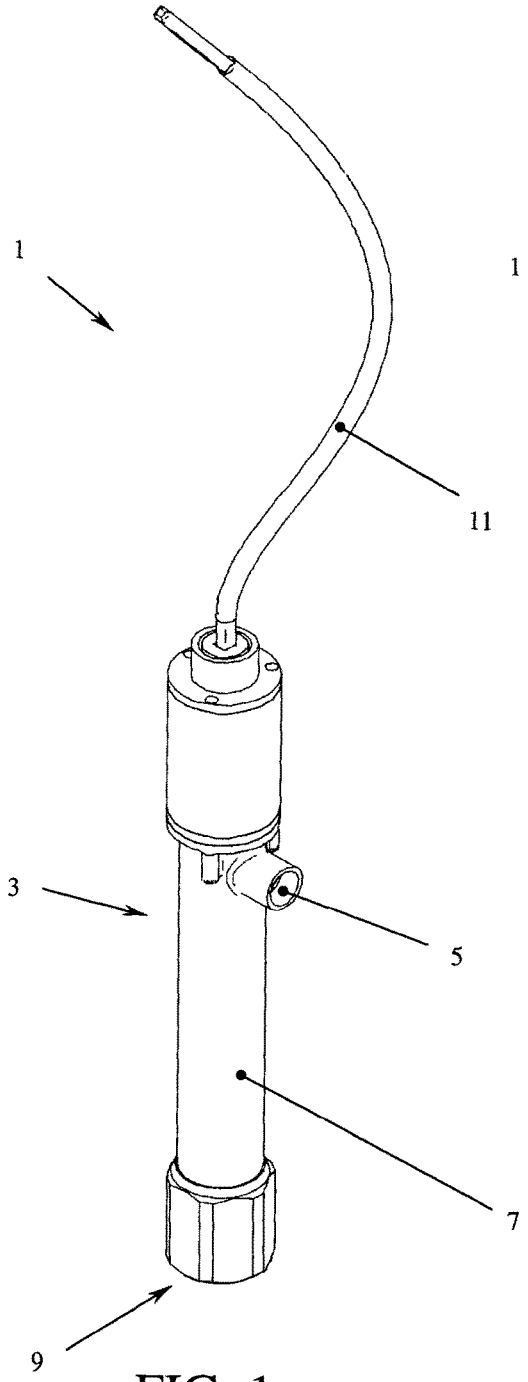
FIG. 1 shows a top perspective view of a preferred embodiment of the remotely actuated volumetric batching pump according to the present invention.
Figure 2:
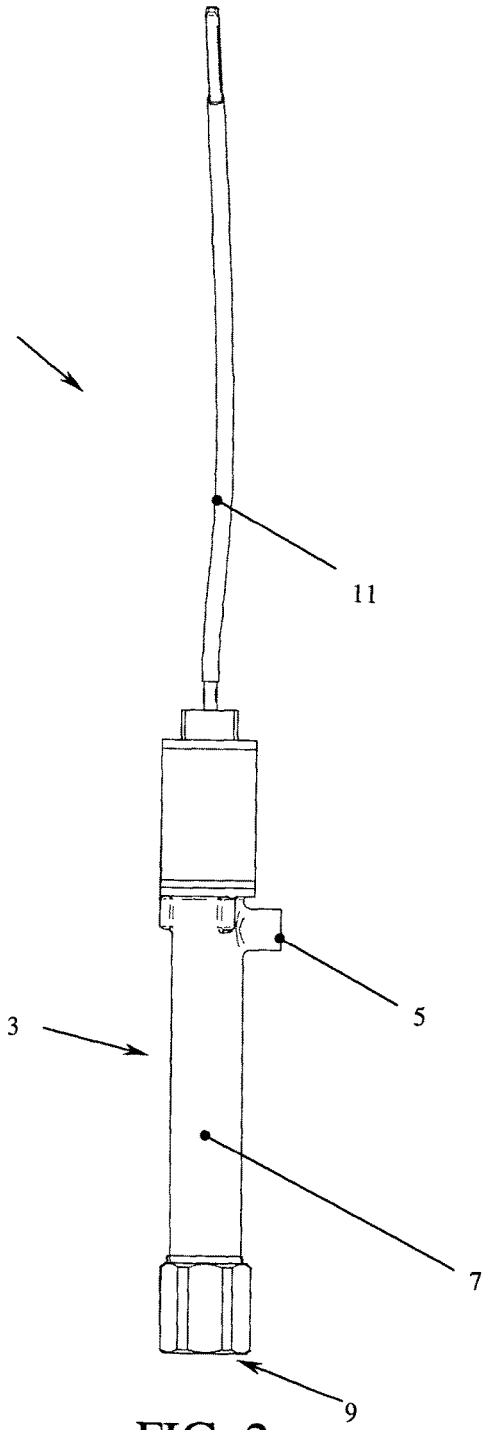
FIG. 2 shows a side view of the remotely actuated volumetric batching pump of FIG. 1.
Figure 3:
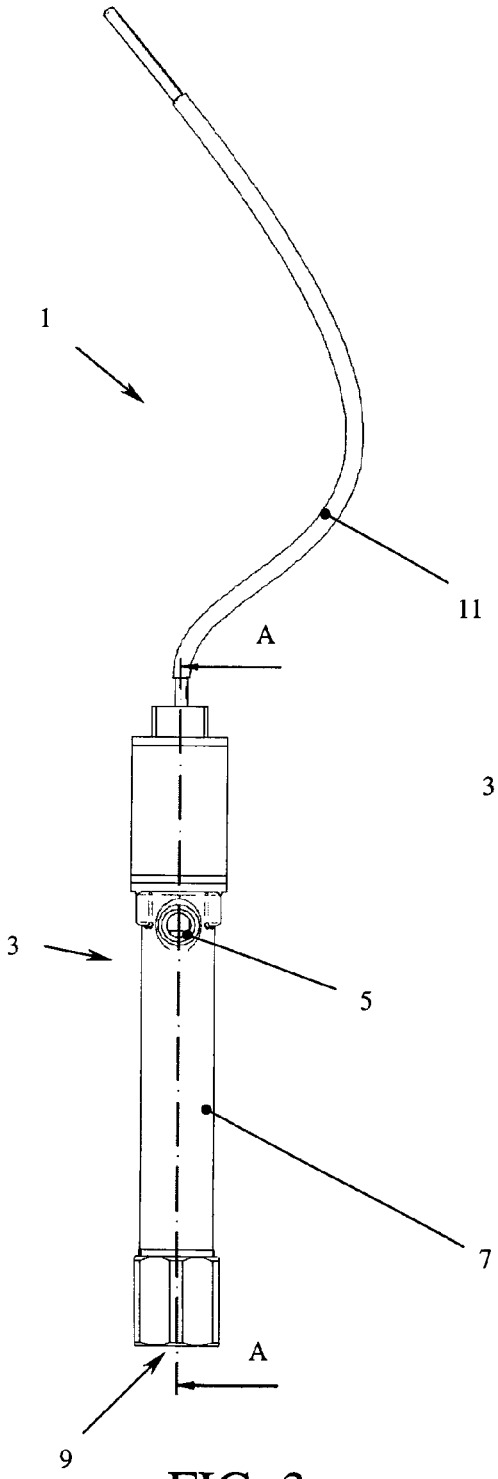
FIG. 3 shows another side view of the remotely actuated volumetric batching pump of FIG. 1.
Figure 4:
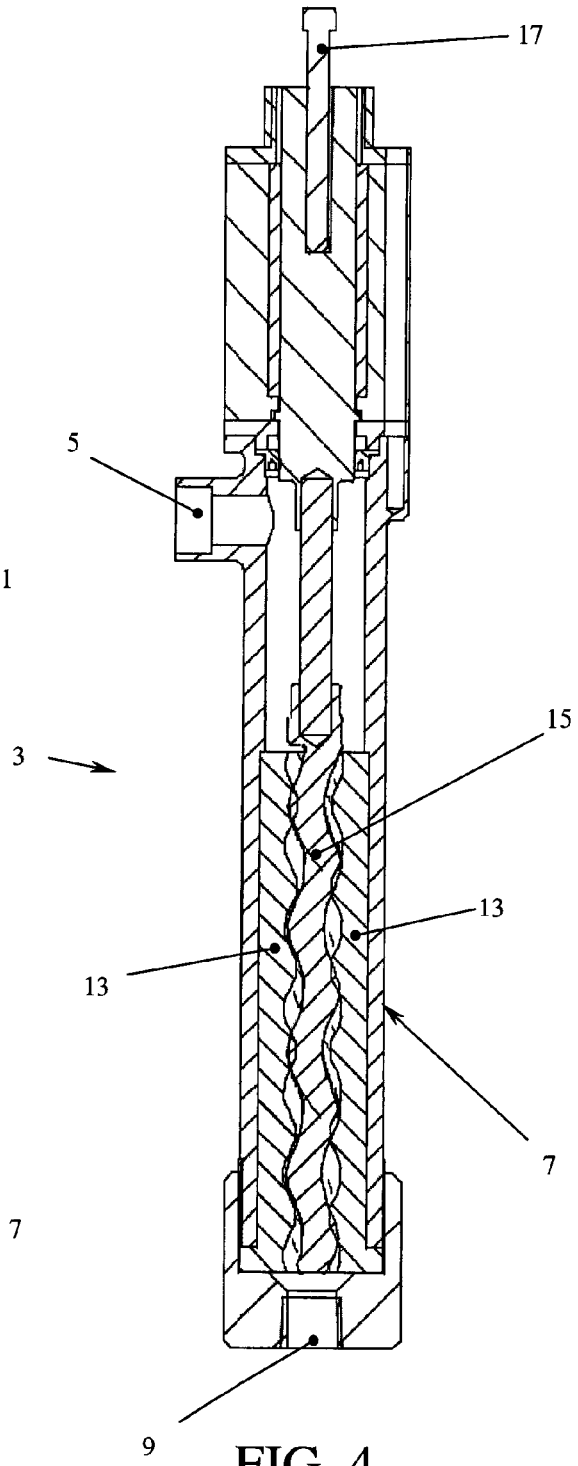
FIG. 4 shows a sectional view of the volumetric batching pump according to the present invention along section line A-A of FIG. 3.

With reference to FIGS. 1 to 4, it is possible to note that the remotely-actuated volumetric batching pump 1 according to the present invention, in particular for delivering and batching high viscosity products such as, for example, glues, mastex, grease, etc., comprises at least one sucking, volumetrically batching and delivering element 3 having a first duct 5 for sucking the product to be batched, at least one volumetric batching device 7 of the product, and at least one second duct 9 for exiting the product batched by the device 7, the device 7 being operatively connected to at least one control motor (not shown) of the operation of the device 7 itself by interposing at least one flexible rotary shaft 11.

Preferably, the volumetric batching device 7 is composed of at least one pump with progressive recesses driven to rotate by the control motor by interposing the flexible rotary shaft 11. In particular, the pump with progressive recesses is substantially composed of an external stator casing 13 and of an internal rotor 15 driven to rotate by the control motor through the rotation of the flexible rotary shaft 11 connected to the internal rotor 15 through a suitable connection appendix 17, the internal rotor 15 being shaped as worm screw with progressive recesses whose relative rotation with respect to the stator 13 generates a translation movement of the product therein. When it is thereby actuated by the control motor through the flexible rotary shaft 11, the pump with progressive recesses, during the rotation movement of its internal rotor 15, transfers certain amounts of product from the first duct 5 for sucking the product to be batched to the second exit duct 9.

The advantages deriving from the use of the pump with progressive recesses are several:

- when the internal rotor is unmoving with respect to the external stator, the pump with progressive recesses guarantees a perfect seal;
- the reliability of the pump with progressive recesses is practically total, since the only moving part is the internal rotor and wear due to revolving friction due to the relative movement between internal rotor and external stator is neglectable;
- the pump with progressive recesses allows a continuous product delivery;
- the pump with progressive recesses allows an extremely accurate product volumetric delivery: in fact, the delivered volumetric batching is proportional to the rotation performed by the internal rotor 15, whose rotation can be controlled down to the order of fractions of a degree;
- it can be provided that, once having ended the product delivery, the control motor can impose to the internal rotor 13, through the flexible rotary shaft 11, a counter-rotation of a suitable entity to avoid possible drippings at second exit duct 9 level.

Figure 5:
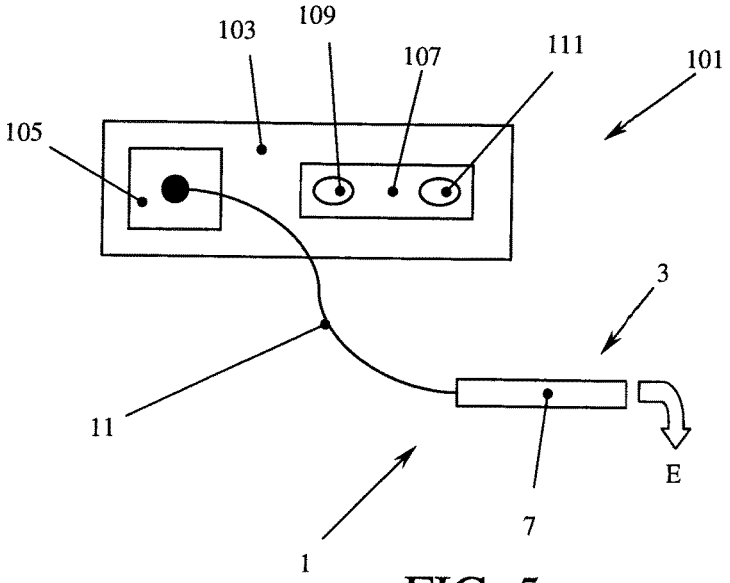
FIG. 5 shows a block diagram which schematically shows a preferred embodiment of the system according to the present invention.
Figure 6:
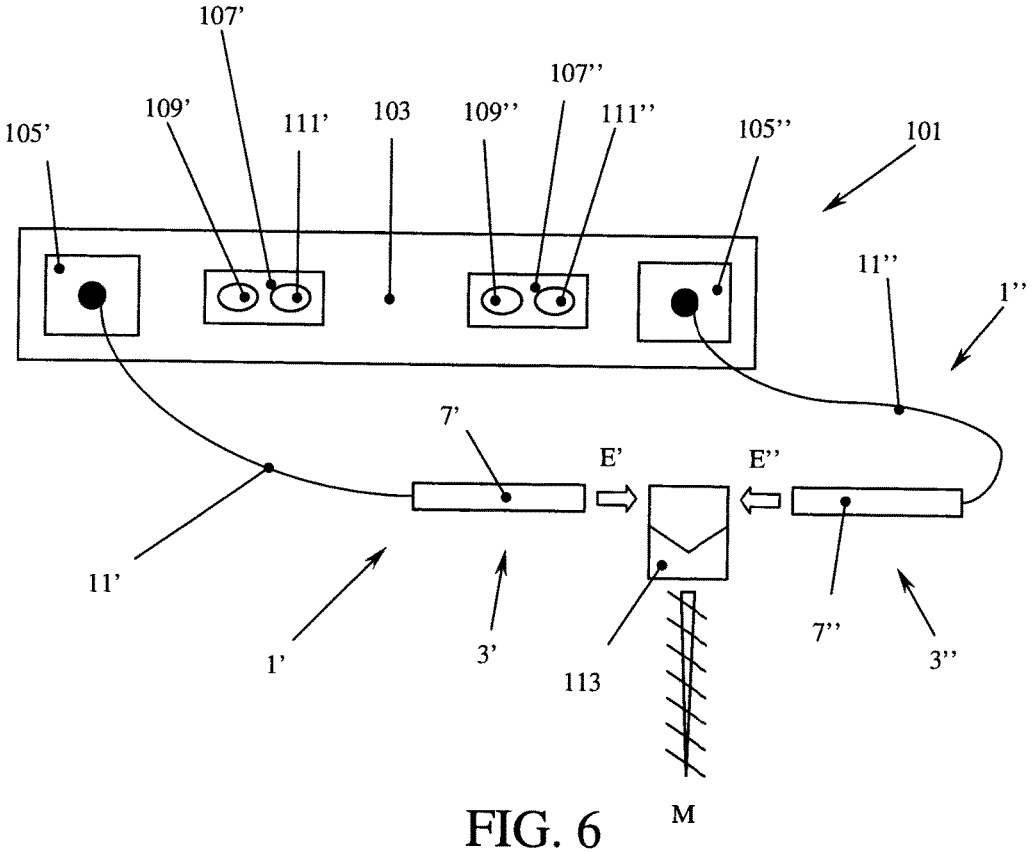
FIG. 6 shows a block diagram which schematically shows an alternative embodiment of the system according to the present invention.

Instead, with particular reference to FIGS. 5 and 6, some preferred embodiments of a batching/delivering system 101 according to the present invention are shown, in particular for delivering and batching high viscosity products such as, for example, glues, mastex, grease, etc.

In particular, the system 101 according to the present invention comprises at least one managing and actuating device 103, the managing and actuating device 103 comprising at least one control motor 105, and at least one batching pump 1 like the previously described one, operatively connected to the control motor 105 by interposing at least one related flexible rotary shaft 11. Obviously, the system 101 according to the present invention can further comprise means (not shown) for supplying and/or storing the product E to be batched and delivered from the batching pump 1, and in particular from the volumetric batching device 7, suitably in fluid connection with the first suction duct of the related sucking, volumetrically batching and delivering element 3.

FIG. 5 shows in particular a system 101 according to the present invention aimed for batching and delivering E a single product, and in such case the system 101 comprises a single batching pump 1 and the managing and actuating device 103 comprises a single control motor 105 operatively connected to the pump 1 through a single respective flexible rotary shaft 11.

Moreover, the managing and actuating device 103 can further comprise at least one control and management consolle 107 for the operation of the system 101 according to the present invention cooperating, through suitable electronic managing means, with the control motor 105 to manage the operation modes (in terms of delivery and batching) of the related batching pump 1. In particular, merely as an example, it is possible to provide that the control and management consolle 107 could comprise at least one first command 109 whose actuation by a user allows a continuous delivery at will of the product and at least one second command 111 whose actuation allows a delivery with preset batching of the product itself.

Alternatively, FIG. 6 shows in particular a system 101 according to the present invention aimed to deliver M a multi-component product, and in particular a two-component product composed of at least one first component product (such as, for example, a resin) and at least one second component product (such as, for example, a catalyst), the system 101 comprising at least one (static or dynamic) mixing device 113 of the component products, at least one first batching and delivering system E' of the first component product in the mixing device 113 and at least one second batching and delivering system E" of the second component product in the mixing device 113, the first batching and delivering system comprising a first batching pump 1' according to the present invention and the managing and actuating device 103 comprising a first control motor 105' operatively connected to the first pump 1' through a respective first flexible rotary shaft 11', and the second batching and delivering system comprising a second batching pump 1" according to the present invention and the managing and actuating device 103 comprising a second control motor 105" operatively connected to the second pump 1" through a respective second flexible rotary shaft 11".

Obviously, also the system 101 according to the present invention can further comprise first means (not shown) for supplying and/or storing the first component product E' to be batched and delivered by the first batching pump 1', and in particular by the first volumetric batching device 7', suitably in fluid connection with the first suction duct of the related first sucking, volumetrically batching and delivering element 3', and second means (not shown) for supplying and/or storing the second component product E" to be batched and delivered by the second batching pump 1", and in particular by the second volumetric batching device 7", suitably in fluid connection with the second suction duct of the related second sucking, volumetrically batching and delivering element 3".

Each of the batching and delivering systems E', E" can further comprise a respective control and management consolle 107', 107" having commands 109', 109" and 111', 111" respectively of the previously described functionalities of delivery at will and of delivery with preset batching.

The invention claimed is:

1. A system for delivering and batching high viscosity products, the system comprising:
   a. at least one managing and actuating device;
   b. at least one sucking, volumetrically batching and delivering element attached to the at least one managing and actuating device, where the at least one sucking, volumetrically batching and delivering element comprises:
   a. a first duct for sucking a product to be batched;
   b. at least one volumetric batching device attached to the first duct;
   c. at least one second duct for exiting the batched product attached to the at least one volumetric batching device; and
   d. at least one control and management console; and
   c. at least one control motor operatively connected to the at least one managing and the actuating device, where the managing and the actuating device further comprises at least one flexible rotary shaft operatively connected to the at least one control motor.

2. The system of claim 1, where the managing and the actuating device further comprises at least one remotely-actuated volumetric batching pump.

3. The system of claim 1, where the volumetric batching device comprises at least one pump with progressive recesses driven to rotate by the control motor interposed on the flexible rotary shaft.

4. The system of claim 3, where the pump with progressive recesses comprises:
   a. an external stator casing; and
   b. an internal rotor electrically connected to the external stator casing and driven to rotate the control motor through a rotation of the flexible rotary shaft connected to the internal rotor.

5. The system of claim 4, where the internal rotor comprises a worm screw with progressive recesses.

6. The system of claim 2, further comprises a storage means for supplying, storing or both supplying and storing the product to be batched and delivered by the remotely-actuated volumetric batching.

7. The system of claim 2, where the storage means is in fluid connection with the first suction duct of the sucking, volumetrically batching and delivering element.

8. The system of claim 2, where the at least one control and management console comprises functions to deliver at will batching by at the least one batching pump.

9. The system of claim 2, where the at least one control and management console comprises functions to deliver preset batching by the at least one batching pump.

10. A system for delivering and batching multi-component high viscosity products, the system comprising:
   a. a first storage for supplying, storing or both supplying and storing at least one first component product;
   b. a second storage for supplying, storing or both supplying and storing at least one second component product;
   c. at least one mixing device operably connected to the first and second storage for mixing at least one of the first component products and at least one of the second component products;
   d. at least one first batching and delivering system connected to the at least one mixing device for delivering the at least one first component product, where the first batching and delivering system comprises:
      1) a first batching pump; and
      2) a managing and actuating device comprising a first control motor operatively connected to the first pump through a respective first flexible rotary shaft;
   e. at least one second batching and delivering system connected to the at least one mixing device for delivering the at least one second component product, where the second batching and delivering system comprises:
      1) a second batching pump; and
      2) a second managing and actuating device comprising a second control motor operatively connected to the second pump through a respective second flexible rotary shaft.

11. The system according to claim 10, where the first batching pump is in fluid connection with a first suction duct of a related first sucking, volumetrically batching and delivering element.

12. The system according to claim 10, where the second batching pump is in fluid connection with a second suction duct of a related second sucking, volumetrically batching and delivering element.

* * * * *